US010415864B2

(12) United States Patent
Choi

(10) Patent No.: US 10,415,864 B2
(45) Date of Patent: Sep. 17, 2019

(54) ICE SLURRY MANUFACTURING PROCESS

(71) Applicant: Peter B. Choi, St. Davids, PA (US)

(72) Inventor: Peter B. Choi, St. Davids, PA (US)

( * ) Notice: Subject to any disclaimer, the term of this patent is extended or adjusted under 35 U.S.C. 154(b) by 540 days.

(21) Appl. No.: 15/016,649

(22) Filed: Feb. 5, 2016

(65) Prior Publication Data

US 2016/0273819 A1 Sep. 22, 2016

Related U.S. Application Data

(60) Provisional application No. 62/114,316, filed on Feb. 10, 2015.

(51) Int. Cl.
*F25C 1/00* (2006.01)

(52) U.S. Cl.
CPC ..... *F25C 1/00* (2013.01); *F25C 2301/002* (2013.01)

(58) Field of Classification Search
CPC ..... F25C 1/00; F25C 2301/002; F25D 17/02; F28D 20/025; Y02E 60/145
See application file for complete search history.

(56) References Cited

U.S. PATENT DOCUMENTS 3,232,069 A * 2/1966 Hawkins ..... A23F 3/24 62/540
3,869,870 A * 3/1975 Kuehner ..... F25C 1/145 62/114
5,598,712 A * 2/1997 Watanabe ..... F25D 16/00 165/104.17
2005/0039883 A1* 2/2005 Kramer ..... C09K 5/10 165/80.3

(Continued)

FOREIGN PATENT DOCUMENTS

JP 297845 A 4/1990
WO 2014012039 A1 1/2014

OTHER PUBLICATIONS

Qianli Chu, Marvin S. Yu and Dennis P. Curran, New Fluorous/Organic Biphasic Systems Achieved by Solvent Tuning, Tetrahedron, Sep. 24, 2007, 63(39), 9890-9895; Relevant pages: p. 12 (Table 3); p. 13 (Table 4).

(Continued)

*Primary Examiner* — Frantz F Jules
*Assistant Examiner* — Martha Tadesse
(74) *Attorney, Agent, or Firm* — John H. Choi & Associates

(57) ABSTRACT

Ice slurry is manufactured in direct contact heat transfer in a tank comprising a layer of heavy solvent, of water dissolving a freezing point depressant, of ice slurry, and of light solvent. The heavy solvent is heavier in density than water, and the light solvent lighter than ice. The heavy solvent, water, and light solvent are immiscible with each other. The freezing point depressant is insoluble in the heavy and light solvents. The light solvent is chilled in a chiller, and injected into the heavy solvent layer, where bubbles of light solvent are generated without ice clogging. The cold liquid bubbles ascending through the water layer produce ice. Ice slurry is continuously withdrawn below the light solvent layer. The light solvent side of the chiller is coated with a hydrophobic coating material to prevent formation of sessile ice particles of the undissolving water molecules from the light solvent.

19 Claims, 6 Drawing Sheets

(56) References Cited

U.S. PATENT DOCUMENTS

2005/0172659 A1* 8/2005 Barker ..... F28D 20/025 62/430
2013/0134102 A1* 5/2013 Buchsbaum ..... A23L 2/70 210/703

OTHER PUBLICATIONS

James A. Heist, Freezing Crystallization, Chemical Engineering, 72-82, May 7, 1979; Relevant pages: p. 78 (Figure 3—Installed Capital Cost, $100,000's vs. Freezer Duty, Thousand Btu/h).

S.A. Kulinich, S. Farhadi, K. Nose, and X.W. Du, Superhydrophobic Surfaces: Are They Really Ice-Repellent?, Langmuir, 27(1), 25-29, 2011; Relevant pages: p. 25; p. 29 (Conclusions).

A.J.B. Milne and A. Amirafazli, Drop Shedding by Shear Flow for Hydrophilic to Superhydrophobic Surfaces, Langmuir, 25(24), 14155-14165, 2009; Relevant pages: p. 14161 (Figure 5).

Robert H. Perry and Don W. Green, Perry's Chemical Engineers' Handbook, Seventh Edition, McGraw-Hill, 1999; Relevant pages: p. 6-50 to p. 6-52 (Particle Dynamics).

Paul Rivet, IIR Review Article: Ice Slurries—State of the Art, Ecolibrium, 28-33, Jul. 2008; Relevant pages: p. 31.

Charles C. Ryerson, Icing Management for Coast Guard Assets, Cold Regions Research and Engineering Laboratory, Engineer Research and Development Center, U.S. Army Corps of Engineers, Apr. 2013; Relevant pages: p. 192 (5-3—Coatings and Surface Treatments); p. 204 (Figure 5-11); p. 211 (Table 5-2—Coating Sources).

Srinivas Bengaluru Subramanyam, Konrad Rykaczewski, and Kripa K. Varanasi, Ice Adhesion on Lubricant-Impregnated Textured Surfaces, Langmuir, 29, 13414-13418, 2013; Relevant pages: p. 13414; p. 13417.

* cited by examiner

ICE SLURRY MANUFACTURING PROCESS

CROSS-REFERENCE TO RELATED APPLICATION

The present application claims the benefit of and priority to U.S. Provisional Application No. 62/114,316, filed on Feb. 10, 2015, the contents of which are incorporated by reference.

FIELD OF INVENTION

The present invention is related to the generation of ice slurry in direct contact heat transfer without problems from ice clogging, enabling to make the scale-up of the plant easier and the installation and operation costs lower.

BACKGROUND OF THE INVENTION

The embodiment system of this invention generates ice slurry in direct contact heat transfer using two immiscible solvents one heavier than water and the other lighter than ice. The system comprises an ice generating tank producing ice by circulating immiscible light solvent as a cold heat transfer medium and a chiller that cools the light solvent stream. As for the ice generation tank of this invention, it generates ice slurry without ice adhesion problems. As for the chiller, it cools the light solvent stream without the problems of plugging by ice adhesion. The prior art is described below with an emphasis on the previous efforts having been made in the industry to resolve the problems of ice adhesion on cold surfaces that have been experienced in the ice slurry generators and solvent chillers.

Ice has been a favorite commodity in human life throughout the history. Innumerous attempts must have been tried to produce it in controllable ways. However, it still remains difficult to resolve the major problem of ice scale formation taking place on the cold heat transfer surfaces. Ice is made in the cold freezer boxes or in the ice makers having scrapers. The scrapers remove ice scale continuously, typically at 450 RPM, from the cold surfaces before the ice accumulates to a thickness at which it is hard to detach the scale due to the high adhesion forces along with a decrease of the heat transfer rates. Even with scrapers, the temperature driving force cannot go much larger than around 5° C., because with the larger temperature differences the ice scale formation becomes too severe to control. This difficulty limits the production capacity of ice makers. In addition, the ice makers with scrapers are mostly custom designed, and the units of larger capacities must be custom designed again rather than being expanded to larger sizes using the regular engineering scale-up rules. In order to circumvent these problems, new ideas of ice generation methods have been tried.

The new ideas have utilized the heat transfer techniques such as the evaporation of water as a refrigerant in vacuum, the direct contact heat transfer with refrigerants that vaporize in the water layer, the direct contact heat transfer with the immiscible solvents cooled by chillers, the super-cooling effect of water, and the fluidized bed freezers. With some exceptions, all these methods still have difficulties for commercial uses. The method of evaporation of water as a refrigerant in vacuum, for example, is in use most successfully for HVAC systems but only at temperatures near the freezing point of water for the applications in large capacities. The direct contact heat transfer with refrigerants or immiscible solvents experiences severe clogging problems due to the adhesion of ice on the cold surfaces around the distributor of cold medium along with many others. The method of using the super-cooling effect of water is not yet fully matured being unstable in operation with difficulties in control. The fluidized bed freezers are still in the development stage with problems similar to the scraped surface ice generators in ice adhesion.

The direct contact heat transfer using immiscible solvent still has a great possibility for ice slurry generation, once the ice clogging problems around the cold solvent distributor are resolved. When a cold solvent lighter than ice in density is injected into the water layer at the bottom of the tank, ice adheres on the cold surfaces of the solvent distributor quickly, resulting in clogging of nozzles. In order to resolve this problem, a solvent liquid heavier than water was injected into the water layer from the nozzles submerged in the heavy solvent layer at the bottom. The heavy solvent droplets shot into the water layer fell back quickly into the heavy solvent layer with a limited residence time resulting in insufficient heat transfer. When the heavy solvent is sprayed above the ice layer at the top of the tank in order to avoid ice clogging, it is difficult to have a controllable liquid distribution. When the solvent is sprayed below the ice layer, ice clogging occurs quickly again due to the adhesion of ice on the cold surfaces of the solvent distributor. The clogging problems around the distributor were well explained in the patent application (US 20050172659 A1), where a divergent inlet nozzle was proposed to resolve the problems.

In order to cool the circulating immiscible solvent stream, this invention uses a chiller having the solvent side heat transfer surfaces coated with a hydrophobic coating material. The hydrophobic coating prevents adhesion on the cold surfaces of the ice particles which are produced by freezing of the water molecules undissolving from the solvent stream. The prevention of ice adhesion is possible because the solvent functions as a lubricant on the cold surfaces allowing no area and residence time for the undis solving water droplets to sit on the cold surfaces and freeze to a sessile particle. The water molecules are produced by undissolving in the immiscible light solvent due to the decreasing solubility of water in the solvent while the solvent is cooled to lower temperatures. The undissolving effect is more significant for the immiscible solvents having high solubility of water than those having low solubility. For example, the solubility of water in toluene is in a range of around a hundred ppm, while that in perfluorohexane (C6F14) less than 10 ppm, and therefore the water freezing problems are more significant with toluene than perfluorohexane. The concerns about blockage of the passages in a chiller by freezing of the water entrained in the cold solvent were explained in the patent application (US 20050172659 A1), where a new type of inlet nozzle for the cold solvent feed was suggested to prevent such entrainment. The same problems must be expected from the water undissolving in solvent as those from the water entrained.

The effectiveness of the coated surfaces with the hydrophobic coating material was tested for icephobicity with a mixture of water and a freezing point depressant or an emulsion of water and oil, and found that the water froze with ice adhering on the cold surfaces. In order to improve the performance of the coated surfaces, a lubricant was applied on the surface and found that, in the atmosphere, the treated surfaces repelled water drops much better than the un-lubricated surfaces, but eventually lost the effectiveness while the lubricant was depleted due to the outside impacts such as those from a torrential rain. The loss of effectiveness was caused by penetration of air and water molecules into the pore structure of the surface as a result of the impacts, and then eventually the air molecules were replaced with water to wet the whole area. The liquid water molecules then became sessile on the surface and could have enough time for heat transfer to freeze. The lubricated hydrophobic surface was called SLIPS (slippery liquid-infused porous surfaces) that mimics the performance of a lotus leaf, and tested for the hydrophobic and icephobic effects mainly in the atmosphere.

Another factor to consider for prevention of ice adhesion in the chiller is the residence time for the water droplets of the undissolving molecules to sit on the cold surfaces for heat transfer to freeze. According to an experiment with a water drop of 2 micro-liters (μl), the drop is carried away by an air stream at the velocities above 5 m/s from the surface coated with superhydrophobic coating material. This means that a sufficient drag force can carry away the water droplets allowing no residence time to freeze on the cold surfaces. Actually, this phenomenon of particle removal makes the application in liquid phase more effective than in air, because the liquid flow can exert the equivalent drag forces at much lower velocities due to its high density compared to the air.

At the present time, no hydrophobic coating materials exist that exhibit icephobicity in actual applications at subzero conditions. In order for the hydrophobic surfaces to show icephobicity, a unique operational environment must be provided while in use in every particular application.

In summary, the ice slurry as a cold energy storage and transfer medium has been mostly used in applications requiring capacities lower than 100 KW (28 refrigeration tons) such as small food and fishing industries. This capacity is about the limit of the mechanical design for scraped surface ice slurry generators because of the ice adhesion problems. For wider applications in industry, however, higher capacities even up to 800 KW are usually necessary. However, the cost of multiple units hampers adoption of this option. The complexities in installation and maintenance are the other issues. A new generation method of simpler design at lower installation costs will stimulate the popularity of ice slurry as a cooling medium in the industries.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The new ice slurry manufacturing process must be easy to scale up and construct for all capacities, inexpensive to build and operate, and reliable for consistent production. This invention illustrates an ice manufacturing process operating in direct contact heat transfer with two immiscible solvents, where the light solvent circulates through a chiller and injected back into the heavy solvent layer that stays stagnant at the bottom of the ice production tank. When the immiscible light solvent is injected into the immiscible heavy solvent layer, there is no free water to freeze and adhere to the cold surfaces of the light solvent distributor. The chiller of this invention is also designed such that no ice blockage takes place due to the undissolution of water from the solvent. The present invention overcomes the difficulties of ice adhesion making the ice slurry manufacturing process of this invention readily utilized for the industry. The present embodiment provides many advantages which are described in detail below.

The problem of forming ice scale on cold heat transfer surfaces in the ice slurry production tank is resolved in this invention by utilizing two immiscible solvents one being heavier than the water and the other lighter than the ice. The light solvent is cooled by an outside chiller and returns back to the tank. The cold immiscible light solvent is injected into the stagnant immiscible heavy solvent layer to generate light solvent bubbles with no ice adhesion, because there are no free water molecules available in the immiscible heavy solvent layer. The light solvent bubbles rise through the water layer exchanging cold energy to produce ice, and collect above the ice slurry layer at the top of the tank. The light solvent stream is then withdrawn from the tank again, and recirculates through the chiller. The ice slurry stream of around 15 wt. % ice is withdrawn below the light solvent layer through an ice slurry downcomer.

The ice slurry downcomer separates the light solvent bubbles from the ice slurry stream. For an effective separation, the velocity of the downward ice slurry flow in the downcomer is maintained below the terminal velocity of the light solvent bubbles but at the same time above the hindered settling velocity of the ice particles with sufficient disengagement height. This velocity allows the light solvent bubbles to float by their buoyant forces from the withdrawing ice slurry stream, but the ice particles to be carried with the ice slurry flow. The disengagement height of the downcommer allows enough time for the light solvent bubbles to escape from the downward ice slurry flow. Any light solvent bubbles still being entrained in the withdrawing ice slurry flow is further separated in the subsequent ice slurry separation tank, and sent back to the ice slurry production tank.

In the ice slurry separation tank, the downward flow in the inverted cone section of the tank is maintained at the hindered settling velocity of the ice particle of wanted size so that the ice slurry flow can carry all ice particles smaller than that size as a homogeneous ice slurry product, and the larger ones float and are separated. The collected light solvent is withdrawn from the tank, and the large ice particles floating at the top of the ice slurry layer are also removed along with the light solvent while they are melted by mixing with the returning warm brine in the feed line before they are fed into the ice slurry production tank. This ice melting step prevents the large ice particles from agglomerating to larger sizes in this closed system of ice slurry manufacturing process.

In this invention, the solvent side heat transfer surfaces of the chiller are coated with a hydrophobic coating material. The light solvent stream undissolves water molecules while it is cooled in the chiller. The higher the amount of undissolving water from the solvent is, the greater is the probability for the water molecules to adhere on the cold heat exchanger surfaces and eventually to cause blockage in the chiller. This invention, therefore, provides operational environments for the hydrophobic coating to prevent the undissolving water molecules from being sessile on the cold surfaces. The prevention of ice adhesion is achieved by using the immiscible light solvent as a lubricant on the coated surfaces.

As a matter of fact, there are no hydrophobic coating materials available that can transfer their water repelling properties at room temperatures to ice repelling properties for the services under sub-zero conditions in actual applications. A typical example of this difficulty is illustrated in the patent application (WO 2014012039 A1), where an immobilized lubricant layer is formed on the hydrophobic substrate surfaces, called SLIPS (slippery liquid-infused porous surfaces), in order to achieve an improved performance for icephobicity under freezing conditions. The SLIPS have a specially designed reentrant curvature at their pore entrances in an attempt to hold the lubricant more securely. Even though the reentrant curvature at the entrances helps the SLIPS maintain the effectiveness of icephobicity longer, they will eventually lose the effectiveness due to the impacts from outside sources as well as the destruction of surface structure while in use in the atmosphere. In this invention, unlike the SLIPS, the hydrophobic coated surfaces are fully exposed to the flowing stream of an immiscible solvent stream and replenished with the solvent freely in order to maintain the capability of icephobicty. Especially, the operating methods of this invention enable both hydrophobicity and icephobicity to be maintained without a time limit as long as the coated surfaces are used accordingly.

In addition, the velocity of the immiscible light solvent flow is maintained high enough so that the undissolving water molecules and the subsequent ice particles are carried away with the solvent stream by drag forces. Also, careful tube bundle design eliminates any possibility of forming stagnant spaces in the solvent side of the chiller so that no accumulation of the undissolving water and subsequent ice can occur. Such unique operating methods enable to preserve both hydrophobicity and icephobicity for the coated surfaces of the chiller in actual production operations.

Additionally, no air or gas bubbles are allowed in the solvent stream during the chilling process in order to prevent the replacement of solvent by the gaseous molecules. The gas molecules in the pore spaces are vulnerable to getting replaced by water molecules, eventually causing wet surfaces. Therefore, the design of the chilling process ensures that no air or gases is entrained into the chiller. Such specific operational environments enable to preserve hydrophobicity and icephobicity for the coated surfaces of the chiller.

The present invention provides a new option for generation of ice slurry. The ice slurry production tank can produce the product in higher capacities at low installation and maintenance costs. For example, unlike the scraped surface generators having capacity limits at around 100 KW (28 refrigeration tons) per a unit, the embodiment of this invention has a capability for much higher capacities because it comprises of unit operations that are easy to design and scale-up. Also, the simple design enables to reduce the installation cost to around one half of that of the scraped surface generators with simple maintenance requirements. Those benefits are made possible because the present invention prevents ice adhesion in the process.

BRIEF DESCRIPTION OF THE DRAWINGS

The foregoing summary, as well as the following detailed description of presently preferred embodiments, will be better understood when read in conjunction with the appended drawings. For the purpose of illustrating the embodiments, there are shown in the drawings embodiments which are presently preferred. It should be understood, however, that the embodiments are not limited to the precise arrangements and instrumentalities shown.

Figure 1:
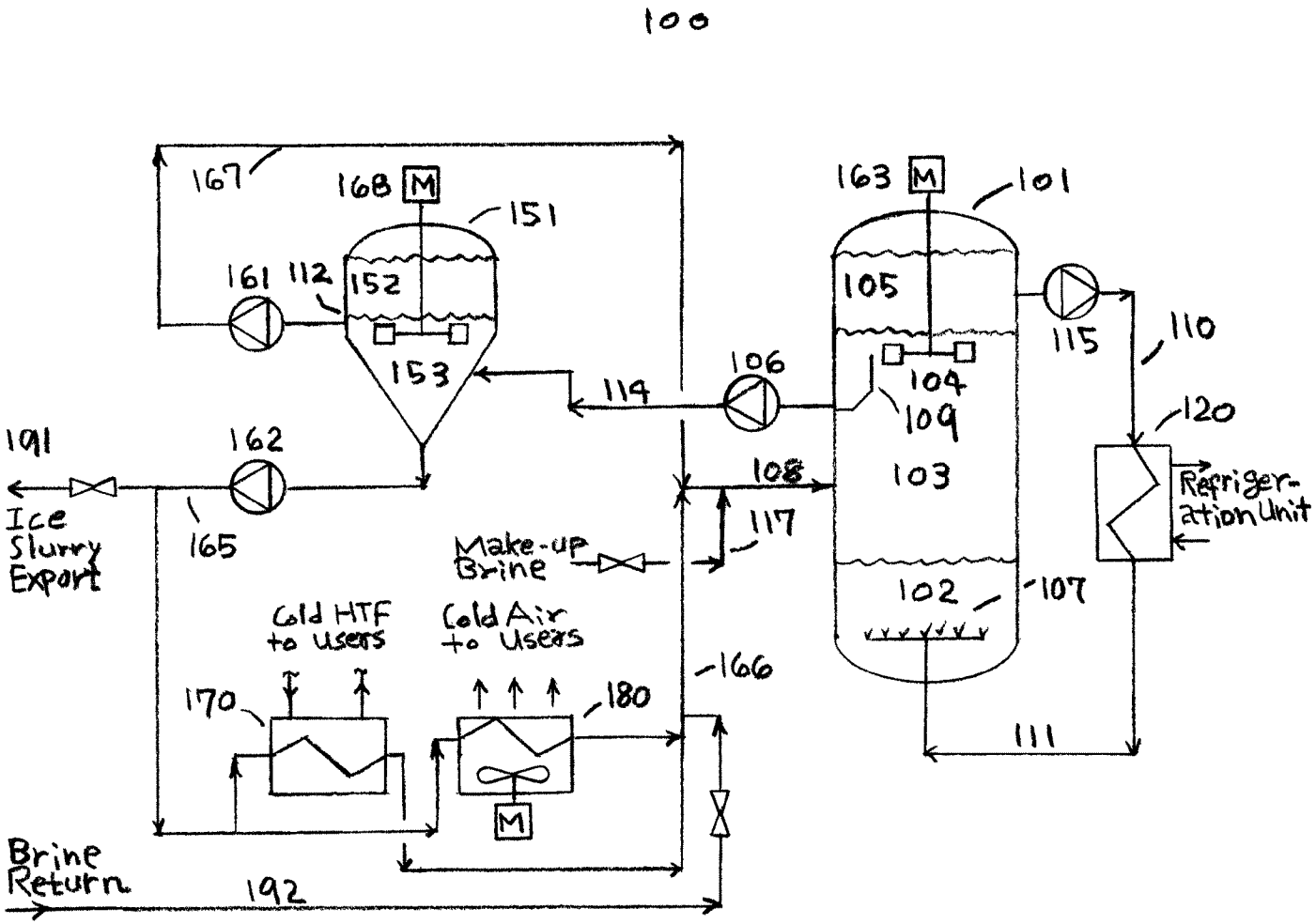
FIG. 1 is a schematic flow chart of an ice slurry manufacturing process comprising an ice production tank, an ice slurry separation tank, and a chiller.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION OF THE INVENTION

The following detailed description is of the best currently contemplated modes of carrying out exemplary embodiments of the invention. The description is not to be taken in a lirr ting sense, but is made merely for the purpose of illustrating the general principles of the invention, since the scope of the invention is best defined by the appended claims.

Certain terminology is used in the following description for convenience only and is not limiting. The article "a" is intended to include one or more items, and where only one item is intended the term "one" or similar language is used. Additionally, to assist in the description of the present invention, words such as top, bottom, upper, lower, front, rear, inner, outer, right and left are used to describe the accompanying figures. The terminology includes the words above specifically mentioned, derivatives thereof, and words of similar import.

Ice slurry manufacturing process 100 of this invention in FIG. 1 generates an ice slurry stream 114 at −5° C. from a brine feed 108 at 1° C. in ice slurry production tank 101 using a chiller 120. The ice production tank 101 has two immiscible solvent layers; a layer 102 being heavier in density than water and the other layer 105 lighter than ice. The ice slurry is produced in direct contact heat transfer with the light solvent bubbles generated by distributor 107 in heavy solvent layer 102. The ice slurry product comprises of 15 wt. % ice particles in sizes ranging from around 100 microns to 1 mm, while the light solvent bubbles are in sizes from around 5 mm to 10 mm. The light solvent bubbles collect in immiscible light solvent layer 105 at the top of the ice slurry production tank. Ice slurry 114 produced in tank 101 is sent by pump 106 to ice slurry separation tank 151 through downcomer 109. The entrained light solvent bubbles are first separated in downcomer 109 and further in ice slurry separation tank 151 from the ice slurry stream by using buoyant forces.

From the ice slurry separation tank 151, stream 167 comprising of the entrained light solvent and the large ice particles is sent by pump 161 to be mixed with stream 166. The homogeneous ice slurry product stream 165 is supplied by pump 162 to the users 170 and 180. The brine stream 166 of the melted ice slurry is recycled to ice slurry production tank 101 from users 170 and 180 along with stream 167. At this time, the large ice particles in stream 167 are melted in stream 108 by mixing with warm returning stream 166. Agitator 163 in ice slurry production tank 101 operates in low speeds to push the ice slurry toward ice slurry downcomer 109, and agitator 168 in ice slurry separation tank 151 to push large ice particles to exit nozzle 112. The ice slurry manufacturing process 100 is a completely closed system requiring very small amount of fresh make-up brine 117.

The ice slurry mixture of 15 wt. % ice is fed into the inverted circular cone section of ice slurry separation tank 151, where it flows down at a specific velocity to carry the ice particles of wanted sizes with it but to release the light solvent bubbles to rise. This inverted cone keeps the ice slurry product to be homogeneous. By being homogeneous, it means that the particles are evenly distributed in the slurry flow without any segregated layer of particles. To form a homogeneous ice slurry mixture without this inverted cone, it usually needs appreciable agitation in a tank as ice tends to float. The entrained light solvent bubbles along with the large ice particles are also separated from the ice slurry product stream in this inverted cone. The ice slurry 191 may be exported when needed, and the used brine 192 returns to the process. The exported ice slurry can be used to produce pure ice particle blocks after the brine removal and water wash steps or stored for later use for the peak shaving of power consumption.

Recirculating cold light solvent stream 111 is continuously injected by distributor 107 into the immiscible heavy solvent layer 102 to generate bubbles of immiscible light solvent without ice clogging, and the bubbles ascend by buoyant forces through water layer 103 exchanging cold energy to produce ice. Returning brine stream 108, a mixture of streams 166 and 167, is continuously fed into the water layer 103. Ice slurry stream 114 of 15 wt. % ice, a Newtonian fluid, is continuously withdrawn through ice slurry downcomer 109. Stream 110 from the layer of collected light solvent is circulated by pump 115 through chiller 120. When this cold immiscible light solvent stream 111 is injected back into immiscible heavy solvent layer 102, ice clogging does not take place because there is no free liquid water available to freeze in the stagnant immiscible heavy solvent layer.

Figure 4:
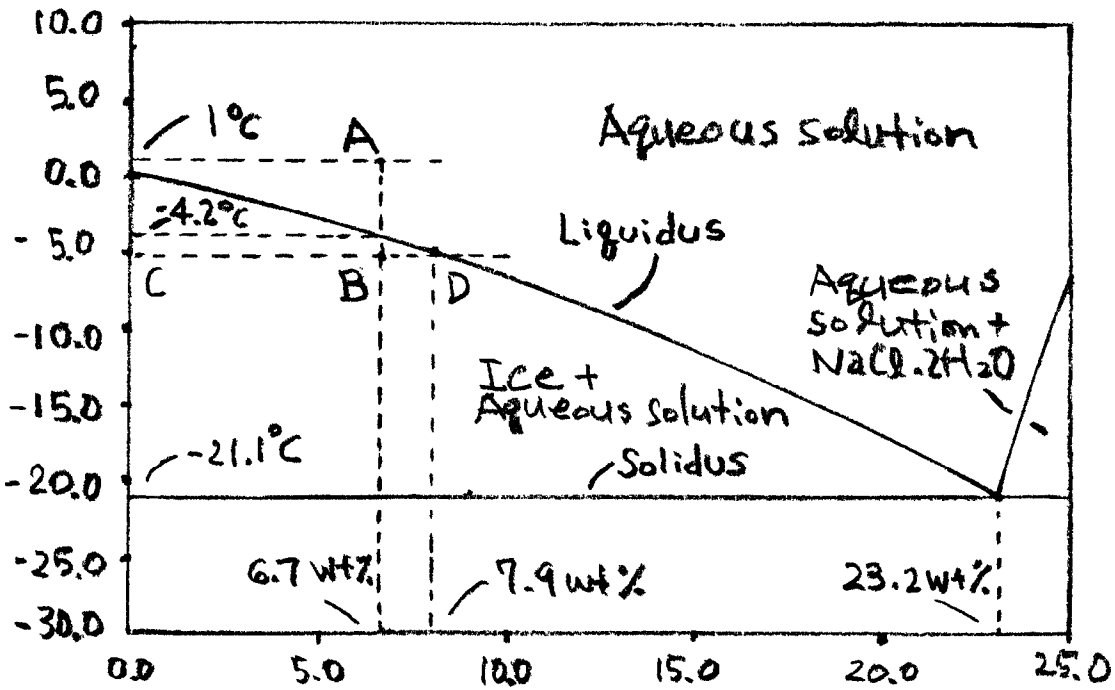
Fig. 4 (Prior Art)
FIG. 4 is a phase diagram of a eutectic system of NaCl—$H_2O$.

The phase diagram of water-NaCl binary system in FIG. 4 shows the operating conditions for the ice slurry production process. A brine feed at point A at 6.7 wt. % NaCl and 1° C. is cooled to −5° C. as shown at point B in the figure, where pure ice crystals are produced. It separates into point C of pure ice and point D of 7.9 wt. % brine. As a result, 15 wt. % of the feed brine is crystallized into pure ice and 85 wt. % of the feed remains as a brine solution of 7.9 wt. % NaCl. The pure ice produced is withdrawn in ice slurry stream 114 that contains 15 wt. % of ice.

Figure 2:
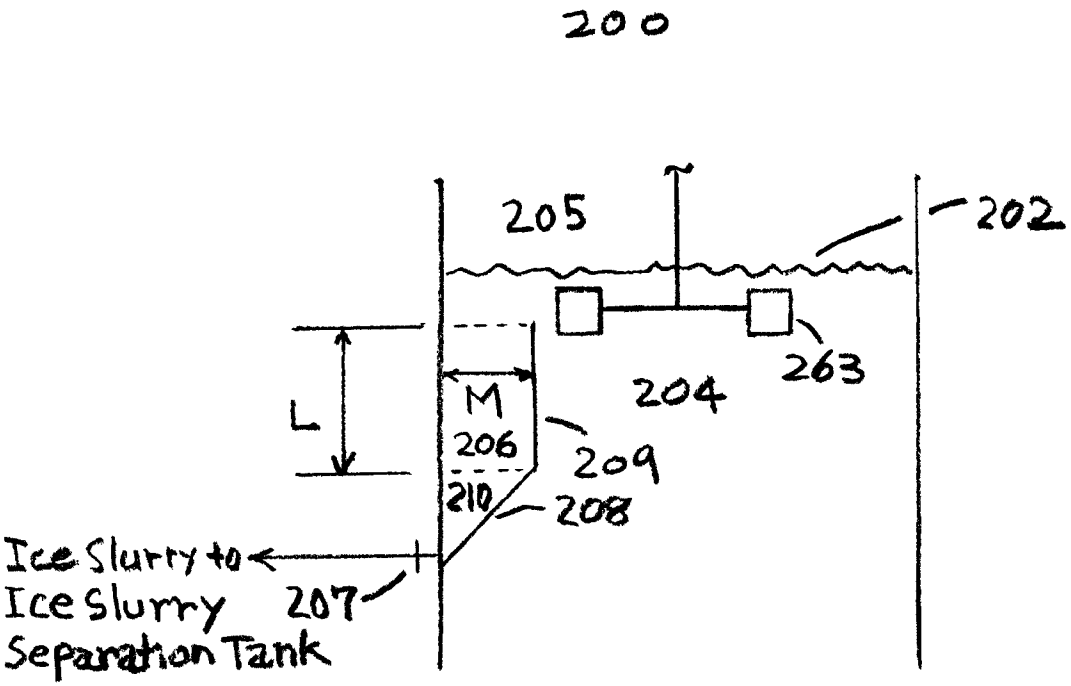
FIG. 2 is a schematic diagram of an ice slurry downcomer.

In order to separate the light solvent bubbles entrained in the ice slurry stream being withdrawn from the ice slurry production tank 101, a downcomer 109 is installed at the wall of the tank. The downcomer system 200 is shown in detail in FIG. 2, which comprises a straight vertical wall 209, sloped wall 208, and outlet nozzle 207. The downcomer provides a disengaging space 206, where any entrained solvent droplets are separated from the ice slurry stream by buoyant forces. In order for the buoyant forces to work most effectively, the downward vertical velocity of the ice slurry flow in the disengaging space must be maintained below the terminal velocity of the light solvent bubbles but higher than the hindered settling velocity of the largest ice particle to recover. The terminal velocity for the solvent bubble in this case is defined as the vertically rising velocity of a bubble of the density lighter than the surrounding fluid owing to the buoyant forces overcoming the frictional drag forces in the quiescent fluid, when the solvent bubble does not interact with other solvent bubbles because the concentration of the bubble is low in the surrounding fluid. The hindered settling velocity for the ice particle is defined as the vertically rising velocity of a particle of the density lighter than the surrounding fluid owing to the buoyant forces overcoming both the frictional drag and interaction forces in the quiescent fluid, when the ice particle interacts with other ice particles with its motion hindered by the interactions. The velocities are calculated by the methods well known to those who are familiar with the field of this art as explained in Perry's Chemical Engineers' Handbook (in the section of Particle Dynamics, Seventh Edition, 1999, McGraw Hill).

The terminal and the hindered settling velocities are calculated using toluene as a light solvent to produce a product of 15 wt. % ice slurry in NaCl brine. The velocities of a spherical toluene bubble of 5 mm in diameter are tabulated in Table 1. The velocities of the ice particles of 2 mm, 1 mm, 0.5 mm and 0.1 mm in diameter are also tabulated in the table. In the ice slurry downcomer 109 and the ice slurry separation tank 151, the surrounding fluid for the toluene bubbles is the ice slurry of 15 wt. % ice at −5° C. The surrounding fluid for the ice particles, on the other hand, is assumed to be the same as the brine of 7.9 wt. % NaCl at −5° C. neglecting the effects of toluene bubbles; based on the preliminary design of the ice slurry production tank made for this invention, the average density change of the surrounding fluid due to the existence of the liquid toluene bubbles is within a few percent so the density reduction has been neglected. For the toluene bubbles, the terminal velocity is more appropriate to use in the downcomer and the ice slurry separation tank because their concentrations must be low, but the hindered settling velocity is more representative in the brine layer of the ice slurry production tank. For the ice particles, the hindered settling velocities are used in all three places. The physical properties needed for the calculation are given in Table 3 and Table 4.

TABLE 1

Terminal and Hindered Settling Velocities

| Settling Object | Size | Reynolds Number | Terminal Velocity | Hindered Settling Velocity |
|---|---|---|---|---|
| Toluene Bubble | 5 mm | 137 | 0.102 m/s | 0.072 m/s |
| Ice Particle | 2 mm | 18.3 | 0.040 m/s | 0.021 m/s |
| Ice Particle | 1 mm | 5.2 | 0.023 m/s | 0.011 m/s |
| Ice Particle | 0.5 mm | 0.7 | $6.7 \times 10^{-3}$ m/s | $2.9 \times 10^{-3}$ m/s |
| Ice Particle | 0.1 mm | 0.02 | $3.4 \times 10^{-4}$ m/s | $1.4 \times 10^{-4}$ m/s |

As shown in the table, the terminal velocity of a toluene bubble of 5 mm in diameter is 0.102 m/s in an ice slurry of 15 wt. % ice at −5° C., and the hindered settling velocity of an ice particle of 1 mm is 0.011 m/s. Therefore, the downward ice slurry flow velocity in the downcomer must be maintained between these two velocities, because the ice slurry flow must carry the ice particles of 1 mm in diameter and smaller with it, while release the toluene bubbles of 5 mm in diameter and larger to float. The volume of disengaging space 206 in the straight vertical wall section depends on the width M and height L for a given circumferential length, and provides enough residence time for the withdrawing ice slurry flow so that the rising light solvent bubbles can escape. Also, the width M determines the cross sectional area of the flow passage for a given circumferential length, which will again determine the average velocity of the ice slurry flow. The height L of the disengaging space, on the other hand, determines the residence time for a solvent bubble to rise to the top of the ice slurry downcomer. For the disengaging height L, a height more than 0.3 m is typically provided. The downward ice slurry fluid then collects at space 210 of the sloped wall, and is discharged through nozzle 207 with no stagnant space. Agitator 263 operates in low RPM to push ice slurry 204 to downcomer 209 below interface 202 with light solvent layer 205.

Figure 3:
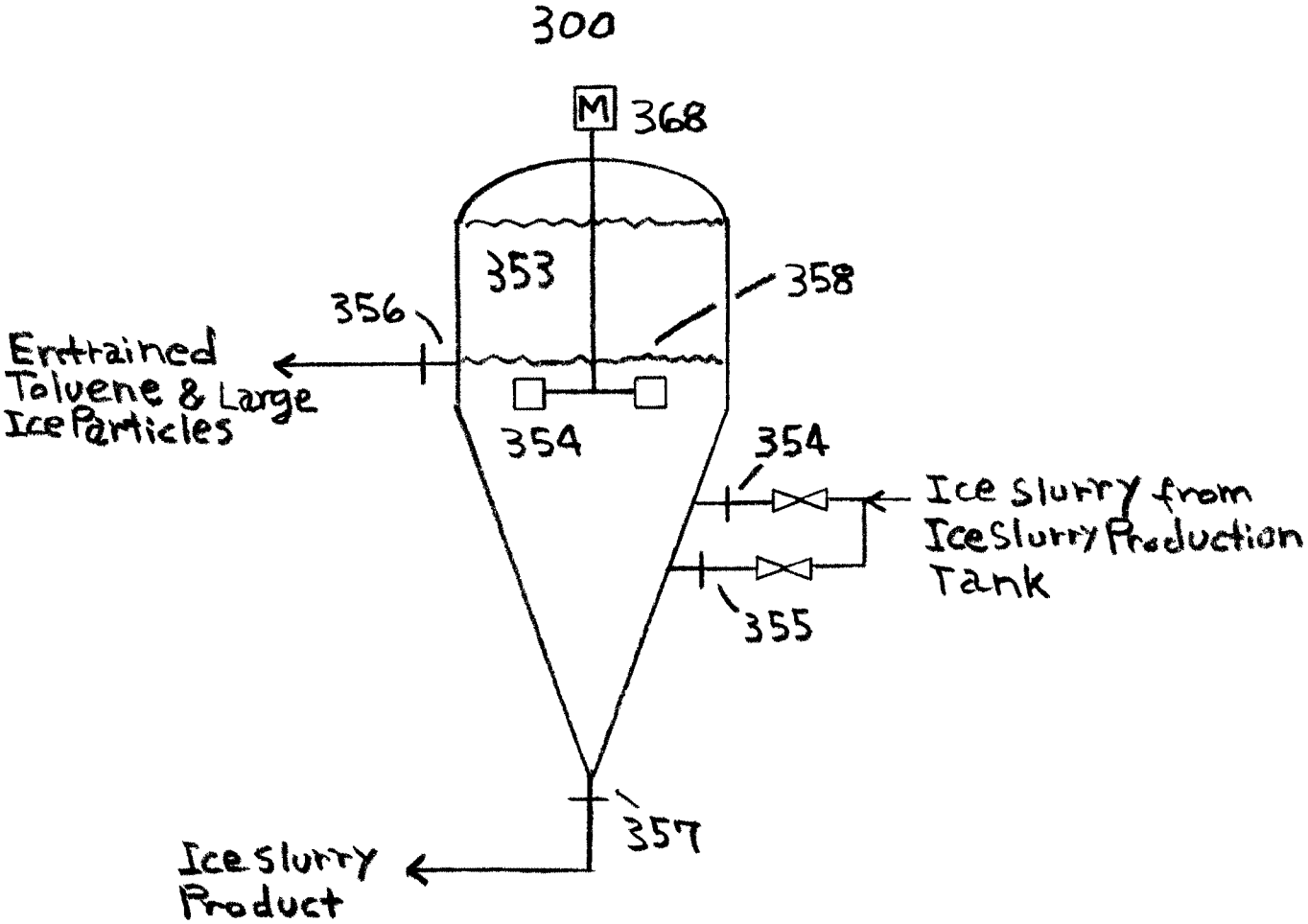
FIG. 3 is a schematic diagram of an ice slurry separation tank having an inverted cone at the bottom section.

The ice slurry separation tank system 300 is shown in FIG. 3. Stream 114 in FIG. 1 is sent to ice slurry separation tank 151 by pump 106, and fed into nozzle 354 in FIG. 3. The inlet nozzle 354 provides a horizontal cross-sectional area of the inverted circular cone through which the inlet ice slurry stream develops the flow velocity necessary to carry the ice particles of the desired sizes. When it is desired to carry the particles of larger sizes, the inlet slurry stream can be introduced into nozzle 355, which will provide a smaller cross-sectional area to carry the larger particles at a higher flow velocity. For example, the ice slurry stream of 110 LPM of 15 wt. % ice slurry with a production rate of 1 ton of ice/hr can be fed into the nozzle 354 that will develop the downward flow velocity of 0.011 m/s, which is the hindered settling velocity to carry the ice particles in diameter of 1 mm and less and release the toluene bubble of 5 mm and larger to rise at its terminal velocity of 0.102 m/s. When it is desired to carry ice particles of 2 mm and lower, the ice slurry stream is fed into nozzle 355 which will develop a flow velocity of 0.021 m/s the hindered settling velocity of the larger ice particle. Therefore, the light solvent bubbles are separated twice, once in the downcomer and again in the ice slurry separation tank. In the meantime, the ice slurry product can be kept homogeneous owing to this inverted cone section, and then pumped directly to the cold energy users 170 and 180 through the outlet nozzle 357. The toluene bubbles collected in the top layer 353 and the large size ice particles floating below the toluene layer are pumped in stream 167 through exit nozzle 356. Agitator 368 operates in low RPM to push the ice particles to exit nozzle 356 below the interface 358 between ice slurry layer 354 and toluene layer 353. The large ice particles are melted by mixing with the warm returning brine stream 166 in the line of stream 108, and the combined stream is fed into ice slurry production tank 101.

Returning brine stream 166 of 6.7 wt. % NaCl, combined with stream 167, is fed into ice slurry production tank 101 as a feed stream 108. Since the agglomerating large ice particles melt at this time, no agglomeration of the ice particles takes place in the closed system of this ice slurry manufacturing process. In heat exchange with homogeneous ice slurry product stream 165, ice slurry user 170 cools a cold liquid HTF for use in the low temperature consumers, and user 180 generates a cold air stream for the cold air consumers. The number and types of the users can change while the ice slurry is supplied in series or parallel to the users between the supply stream 165 and the return stream 166.

The ice slurry manufacturing process of this invention needs two solvents one heavier in density than water and the other lighter than ice. The heavy solvent, light solvent and water are immiscible with each other. The freezing point depressant, on the other hand, must be soluble in water, but insoluble in the solvents. We have found that the system comprising perfluorohexane (C6F14), toluene, and water with NaCl as a freezing point depressant satisfies these requirements. By being immiscible, it means that the liquid solutions make distinct liquid phases after thorough mixing; the distinct liquid phases, however, can still dissolve the components between each other. The miscibility is strongly dependent on temperature. Therefore, an immiscible binary mixture at a low temperature may form a miscible mixture at higher temperatures. The mutual solubility of perfluorohexane (C6F14), toluene and water is illustrated in Table 2.

TABLE 2

Mutual Solubility of Solvents and Water (1)

| | $C_6F_{14}$ | Toluene | Water |
|---|---|---|---|
| in $C_6F_{14}$ | N/A | 2.0 (1) | 10 ppm (2) |
| in Toluene | 1.2 (1) | N/A | 567 ppm (2) |
| in Water | <5 ppm (2) | 520 ppm (3) | N/A |

Note:
(1) Solubility in volume % at room temperature
(2) At 25° C.
(3) At 20° C.

The relevant physical properties of the four components being used in the process of this invention perfluorohexane ($C_6F_{14}$), toluene, water and ice are listed in Table 3.

TABLE 3

Physical Properties of $C_6F_{14}$, Toluene, Water and Ice

| Property | $C_6F_{14}$ | Toluene | Water | Ice |
|---|---|---|---|---|
| Molecular Weight | 338 | 92.1 | 18 | 18 |
| Density (Kg/M$^3$) | 1680 (1) | 886 (2) | 999.8 (3) | 916.2 (2) |
| Melting Point (° C.) | −90 | −95 | 0 | 0 |
| Boiling Point (° C.) | 56 | 111 | 100 | 100 |
| Flash Point (° C.) | N/A | 6 | N/A | N/A |
| Auto Ignition Point (° C.) | N/A | 530 | N/A | N/A |
| Specific Heat Capacity (KJ/Kg · ° C.) | 1.1 (1) | 1.6 (2) | 4.2 (3) | 2.05 (2) |

TABLE 3-continued

Physical Properties of $C_6F_{14}$, Toluene, Water and Ice

| Property | $C_6F_{14}$ | Toluene | Water | Ice |
|---|---|---|---|---|
| Therm. Cond. (W/M · ° C.) | 0.057 (1) | 0.144 (2) | 0.57 (3) | 2.22 (2) |
| Viscosity (mPa · s) | 0.64 (1) | 0.77 (2) | 1.79 (3) | N/A |

Note:
(1) At 25° C.
(2) At 0° C.
(3) At 0.01° C.

Physical properties of the ice slurry must be known for process design of the ice slurry manufacturing plant. For density, specific heat capacity, thermal conductivity and viscosity, the following equations are used, where ρ, Cp, k and μ stand for density in Kg/M3, specific heat capacity in KJ/Kg·K, thermal conductivity in W/m·K, and viscosity in Pa·s, respectively, while subscripts b, i, and m for brine, ice, and mixture of ice slurry, respectively. For density ρ, the weight fraction averaged value is expressed by the following equation $$\rho_m=1/[w_i/\rho_i+(1-w_i)/\rho_b]$$

where Wi stands for weight fraction. For specific heat capacity, the following equation is used.

$$Cpm=WiCpi+(1-Wi)Cpb$$

For thermal conductivity k, the following equation is recommended, where Wiv stands for volumetric fraction.

$$k_m=k_b\{[2k_b+k_i-2w_{iv}(k_b-k_i)/[2k_b+k_i+w_{iv}(k_b-k_i)]\}$$

For dynamic viscosity μ, the following equation is used.

$$\mu_m=[\mu_b(1+2.5w_{iv}+10.05w_{iv}^2+0.00273.10^{-3}\cdot e^{16.6Wiv})$$

The calculated values of the physical properties are given in Table 4.

TABLE 4

Physical Properties of Brine, Ice, and Toluene at −5° C.

| Property | 7.9 wt. % NaCl Brine | Ice | 15 wt. % Ice Slurry | Toluene |
|---|---|---|---|---|
| Density (Kg/M$^3$) | 1062 | 917.5 | 1037.7 | 890.5 |
| Heat Capacity (KJ/Kg · K) | 3.76 | 2.07 | 3.51 | 1.61 |
| Therm. Cond. (W/M · K) | 0.54 | 2.25 | 0.58 | 0.14 |
| Viscosity (mPa · s) | 2.32 | N/A | 4.09 | 0.83 |
| Heat of Fusion (KJ/Kg) | N/A | 333.6 (1) | N/A | N/A |

Note:
(1) At 0° C.

In addition to perfluorohexane ($C_6F_{14}$) as an immiscible heavy solvent, the mixtures of a perfluorocarbon such as perfluorohexane ($C_6F_{14}$) and a hydofluoroether such as perfluorobutyl methyl ether ($C_4F_9OCH_3$) make binary liquid solutions that are immiscible with toluene and water. For example, the binary mixture comprising perfluorohexan ($C_6F_{14}$) and 3-ethoxy-1,1,1,2,3,4,4,5,5,6,6,6-dodecafluoro-2-trifluoromethyl hexane ($C_3F_7CF(OC_2H_5)CF(CF_3)_2$) or perfluorohexane ($C_6F_{14}$) and perfluorohexylethyl 1,3-dimethylbuthyl ether also makes a miscible binary solution which is immiscible with toluene and water in certain concentrations. Therefore, the binary mixtures are good candidates for the heavy solvent. Especially, the hydrofluoroethers are lower in price than the perfluorocarbons.

Figure 5:
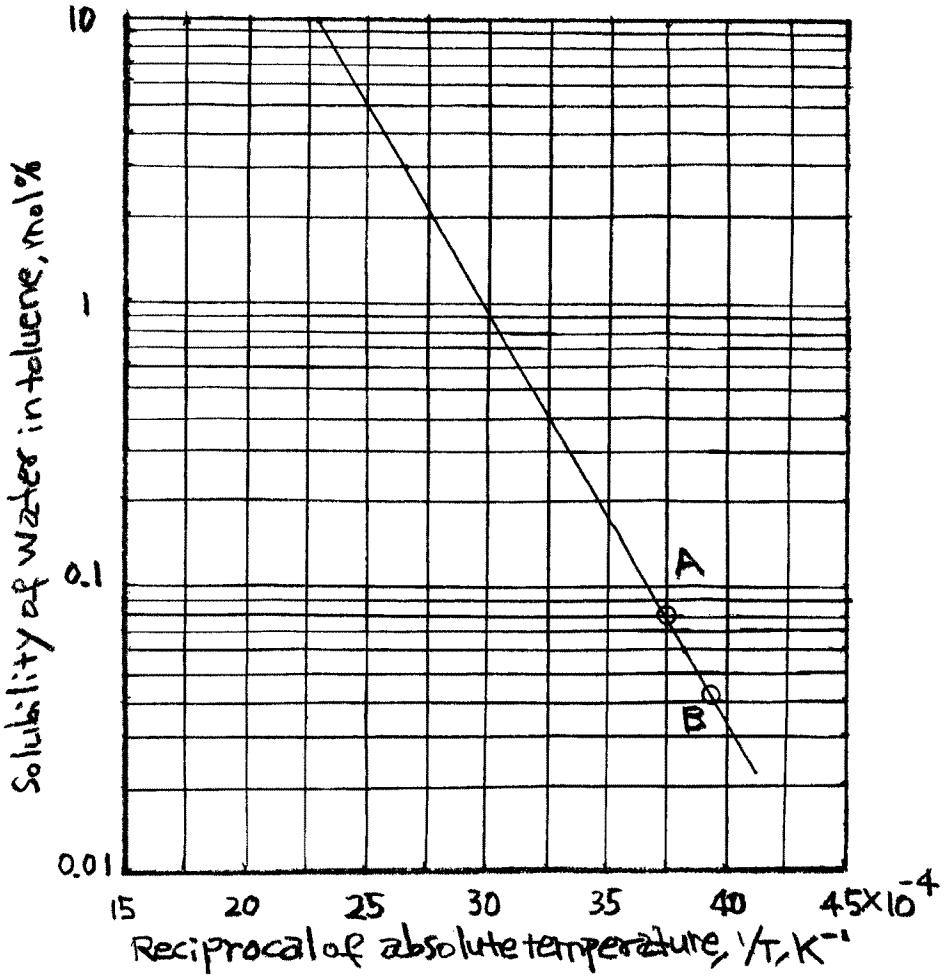
Fig. 5 (Prior Art)
FIG. 5 is a diagram of solubility of water in toluene.

For a proper operation of the ice slurry manufacturing process, the chiller must be designed such that the blockage does not take place due to the ice adhesion and accumulation. This problem is more significant when the amount of undissolving water in the solvent is high. For example, toluene dissolves water in a range of a hundred ppm at the operating temperatures, while perfluorohexane in around 10 ppm. When the toluene stream is chilled from −5° C. to −15° C. in the chiller, the solubility of water decreases from 152 ppm (point A) to 82 ppm (point B) as shown in FIG. 5. For production of 1 ton of ice/hr for 15 wt. % ice slurry product, about 420 LPM of toluene must be recirculated through the chiller with the chiller inlet temperature of −5° C. and outlet temperature of −15° C. The recirculating toluene stream, in this case, generates about 1.6 Kg/hr of water. When this amount of water remains as solid ice in the chiller, it is a sufficient amount to block the passages of the solvent in a few hours.

Owing to the icephobicity of the coated surfaces in this invention, the undissolving water and the subsequent ice particles do not adhere on the cold surfaces, but are all carried away into the ice slurry production tank. The unique operation methods described below enable the coated surfaces to exhibit the icephobicity in actual applications in subzero conditions. According to an experiment for the drop shedding by Milne and Amirfazli, a water drop of 2 microliters (μl) was carried away by an air stream at the velocities above 5 m/s from the superhydrophobic surface and 20 m/s from the hydrophilic surface. This result suggests that, even with superhydrophobic surfaces, the water drop will possibly be sessile and then freeze into ice if there are not enough drag forces by the surrounding fluid. It also suggests that it is more probable with hydrophilic surfaces for the water drops to be sessile and freeze. This conclusion is consistent with the observations made by other researchers that icephobicity is not directly related with hydrophobicity. This is because the icephobicity also depends on other factors from the environment where the surfaces are exposed to. In this invention, therefore, all possible options are incorporated in order to prevent ice adhesion on the cold heat transfer surfaces.

Figures 6A, 6B, 6C, 6D:
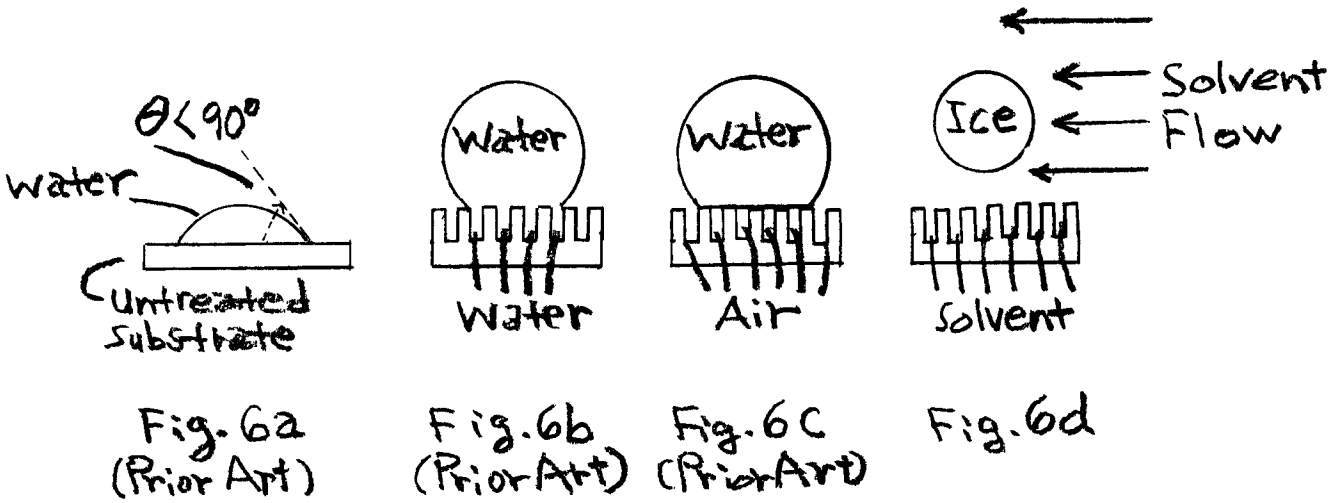
Fig. 6a (Prior Art)
Fig. 6b (Prior Art)
Fig. 6c (Prior Art)
FIG. 6*a* is a schematic diagram of a sessile water drop sitting on a smooth hydrophilic surface of uncoated base substrate in air.
FIG. 6*b* is a schematic diagram of Wenzel state where a water drop contacts the bottom of the ridges, with water replacing air in the spaces between the ridges, on a rough surface in air.
FIG. 6*c* is a schematic diagram of Cassie-Baxter state where a water drop sits on the top of the ridges, with the spaces between the ridges occupied with air, on a rough surface in air.
FIG. 6*d* is a schematic diagram of a water drop or an ice particle carried away by a chilled solvent flow from an icephobic surface that is completely submerged in a flowing immiscible solvent.

In this invention, the hydrophobicity of the coated surfaces of the solvent side of the chiller is transferred to icephorbicity by submerging the surfaces in the flowing immiscible solvent. This icephorbicity ensures that the free water molecules undissolving in the chilled solvent readily carried away by the main flow of the immiscible solvent stream by drag forces before the water droplets become sessile locally on the cold heat transfer surfaces. Hydrophobic coatings are known to form rough surfaces comprising of random ridges as shown in FIG. 6*b* to FIG. 6*d*; with air filled in the spaces between the ridges, this roughness makes water drops in micron sizes to sit on the top of the ridges as shown in FIG. 6*c* making a Cassie-Baxter state rather than being sessile on an untreated surface as shown in FIG. 6*a* in a completely wet state or in FIG. 6*b* on a treated surface in a Wenzel state. Those rough surfaces are produced by applying the hydrophobic coating material on the surfaces of a hydrophilic base substrate. The hydrophilic surfaces of such a base substrate are illustrated in FIG. 6*a*, where a water drop in air spreads out on a flat surface and become sessile with the contact angle θ less than 90°.

The hydrophobic coating materials are readily available in marketplaces, being made from a wide range of different materials comprising of polymeric materials such as PTFE and silanes, inorganic materials such as silica and titania, or their combinations thereof. The hydrophobic surfaces as represented in FIG. 6*c* in a Cassie-Baxter state lose their water repelling capability, when the air in the pore spaces between the ridges is displaced by water as shown in FIG. 6*b* in a Wenzel state. For example, in nature, such hydrophobic surfaces lose their ability to repel water after they are exposed to a torrential rain or strong waves on a ship. Also, such hydrophobic surfaces lose their ability due to the loss of air molecules by diffusion into the water phase, when the surfaces are submerged in water. Another cause for the loss of hydrophobicity is the destruction of the ridge structure due to the repetition of freezing and deicing procedures. Therefore, for the ice slurry manufacturing process of this invention, the coated surfaces of the chiller is not allowed to contact the brine water directly for heat transfer. Instead, the brine is kept away from the coated surfaces, and only the flowing immiscible solvent is allowed to contact them. This unique operation method of this invention makes it possible to maintain the icephobicity on the coated surfaces, and consequently the free water molecules liberated in the chilled solvent stream do not become sessile on the cold heat exchange surfaces but are carried away with the main stream of solvent as shown in FIG. 6*d*.

Therefore, the equipment is designed to develop sufficient drag forces so that the water droplets forming from the undissolving free water molecules are readily carried away by the main flow of immiscible solvent stream. The circulation pump needs to perform adequately so that a sufficient velocity of the solvent flow can be maintained for generation of drag forces on the undissolving water droplets and the subsequent ice particles that form during chilling. Also, the tube bundles must be carefully designed so that no stagnant spaces develop in the passages of the solvent. Therefore, a design such as U-tube is preferred.

In summary, the problem of the blockage by ice adhesion in the chiller is overcome in this invention by providing the environments for the hydrophobic coated surfaces to exhibit the necessary icephorbicity while in operation. The environments are successfully provided by taking the following measures; firstly, the coated surfaces are let remain immersed in the flowing immiscible solvent all the time; secondly, sufficiently high velocity of the immiscible solvent flow is maintained in order for the free water droplets and ice particles to be carried away by drag forces; thirdly, no stagnant spaces are allowed in the solvent side of the chiller where otherwise water drops could possibly become sessile due to the stagnation of solvent flow.

The additional heat transfer resistance due to the coating layer must be carefully addressed in this invention. A coating layer of a thickness of 150 microns with a thermal conductivity of 0.2 W/m·K yields a 25% increase of heat transfer resistance on a regular shell and tube heat exchanger for such chilling services. Fortunately, some of the hydrophobic coating materials, for example PTFE (polytetrafluoroethylene), provide an excellent corrosion resistance against the aqueous solutions of many salts. Such corrosion resistant materials have been used throughout the industries for many decades. With the additional benefit of corrosion resistance, the coating material provides an opportunity to generate the ice slurry resolving the chronic problems of the ice adhesion and the corrosion by salt solutions at the same time.

The issue on the sacrifice of COP by having lower evaporator temperatures for the type of ice slurry generator of this invention, compared with the scraped surface type, has been carefully evaluated with some typical example applications. When an ice slurry generator of scraped surface type operates at a brine temperature of −5.0° C. with the refrigerator evaporator temperature of −15° C. and the condenser temperature of 35° C., this refrigeration system has a Carnot Cycle COP of 5.2. On the other hand, in order for the type of ice slurry generator of this invention to operate at the same brine temperature of −5.0° C., the evaporator must operate at −25° C. with a temperature rise of 10° C. allowed for the immiscible solvent as a sensible heat carrier of cold energy and a temperature difference of 10° C. for heat transfer on chiller tubes. In this latter case, the refrigeration cycle has an ideal COP of 4.1. In this case. the power sacrifice due to the loss of COP for the cooling duty of 100 KW in the ice slurry generator is 4.8 KW. This cooling duty is for the sum of the sensible heat to cool the total ice slurry mixture from −4° C. to −5° C. and the latent heat for freezing 1 ton of ice/hr. In the precooler the total brine feed is cooled from 1° C. to −4° C. with no ice formation.

It is commonly understood that, with the direct contact heat transfer using immiscible solvent, an excessively large volume of immiscible liquid must be recirculated to transfer cold energy in a form of sensible heat from the refrigeration evaporator to the salt brine in the ice slurry production tank. The issue on the additional power consumption for the solvent circulation pump has been carefully evaluated for a production rate of 1 ton of ice/hr as tabulated in Table 5. The solvent circulation pump 115 in FIG. 1 having a pumping rate of 420 LPM with a head of 200 KPa (30 psi) takes about 2.0 KW. The ice slurry pump 106 and the recovered toluene pump 161 require 0.5 KW each. The homogeneous ice slurry product pump 165 is not included in this tabulation because the ice slurry product complying with the product specification has been manufactured before this pump.

For the process of this invention, an agitator 163 is operating at low RPM to push the ice slurry to the downcomer in the ice slurry production tank of a volume of around 8 to 12 $M^3$, and an agitator 168 at low RPM to push toluene liquid and large ice particles to the exit in the ice slurry separation tank of around 2 to 4 $M^3$. The agitators require about 0.5 KW each.

Scrapers remove ice scale while operating at a speed of 450 RPM. It uses power at 1.2 to 1.8 $KW/M^2$ of heat transfer area with the average value of 1.5 $KW/M^2$ used in this comparison. The heat flux for the scraped surface type reaches up to 15 to 20 $KW/M^2$ of heat transfer area with the average of 17.5 $KW/M^2$ used. Therefore, for a capacity of 100 KW, the ice slurry generator requires around 8.6 KW for the scraper operation.

The power consumption for the pumps, agitators and scraper is the realistic power usage expected to operate each system. The power consumption for the COP sacrifice, on the other hand, is the difference of the power requirements due to the difference of the evaporator temperatures of the refrigerators for the two systems. The power consumption for the two systems is compared in Table 5.

TABLE 5

| Comparison of Power Consumption for Two Types of Ice Slurry Generator | | |
|---|---|---|
| | Type | |
| | Direct Contact Heat Transfer of This Invention | Scraped Surface Type |
| Capacity | 1 ton ice/hr (15 wt. % ice slurry) | 1 ton ice/hr (15 wt. % ice slurry) |
| Precooler | 35 KW | 35 KW |
| Ice Slurry Generator | 100 KW | 100 KW |
| | Power Consumption | |
| Scraper | NA | 8.6 KW |
| Agitators | 1.0 KW (1) | N/A |
| Pumps | 3.0 KW (2) | N/A |
| COP Sacrifice | 4.8 KW | N/A |
| Total | 8.8 KW | 8.6 KW |

Note:
(1) For 2 agitators
(2) For 3 pumps

The numbers in the table signify that, for production of 15 wt. % ice slurry comprising of 1 ton of ice/hr, the difference on power consumption is almost negligible with only 0.2 KW. However, the total installation cost of the direct contact heat transfer system is very low at about one half of that of the scraped surface systems. For example, according to the installation cost data for freezers by Heist, the installation cost for the freezer of a capacity of 800 KW without scraped surface is about $700,000 while the freezer of the same capacity with the scraped surface $1,900,000 based on the 1979 prices. This is because the former does not use any moving parts such as the scrapers that contribute mainly to the high costs. The complexity of the mechanical design for the moving parts limits the production capacity of the latter type generators. For example, the scraped surface type has the maximum capacity of around 100 KW per a unit. For the industry where cooling duty often reaches up to 800 KW, the option of installing up to 8 identical units in parallel must be too burdensome.

In addition, the maintenance for the scraped surface type requires great efforts due to the necessity of intimate care for the moving parts. The direct contact heat transfer type of this invention, on the other hand, is simple in mechanical design requiring normal maintenance efforts such as for the regular chemical plants. The feed, a brine of around 6 wt. % NaCl, is more environmentally friendly than the ethylene glycol solutions that are frequently used for ice slurry generation for the industrial users. The embodiment of this invention will contribute to the wider acceptance of the ice slurry technology by the industries as an affordable option for cooling applications.

When toluene is used as an immiscible light solvent, special attention must be given to the fire hazards. Since it has a flash point of 6° C. and an auto ignition point of 530° C. as shown in Table 4, it is very safe to use the solvent at sub-zero temperatures. However, the head spaces of ice slurry production tank 101 and of ice slurry separation tank 151 in FIG. 1 must be blanketed with nitrogen gas an inert gas widely used in the industry for this purpose.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope

I claim:

1. An ice slurry production tank comprising:

a. a layer of heavy solvent immiscible with water and a light solvent, wherein said heavy solvent is higher in density than said water, and said heavy solvent is composed of perfluorohexane ($C_6F_{14}$);

b. a layer of said water;

c. a layer of ice slurry, wherein said ice slurry floats in said water;

d. a layer of said light solvent immiscible with said water and said heavy solvent, wherein said light solvent is lower in density than ice, and said light solvent is composed of toluene ($C_7H_8$);

e. wherein said light solvent is withdrawn and chilled to subzero temperatures in an outside chiller and injected back into said layer of heavy solvent as a cold energy carrier with bubbles of said light solvent being generated; wherein said bubbles of said light solvent rise by buoyant forces through said layer of heavy solvent and said layer of water producing ice in direct contact heat transfer; wherein said bubbles of said light solvent collect above said layer of ice slurry and are withdrawn from said ice slurry production tank.

2. The ice slurry production tank of claim 1, further comprising a separation means that separates said bubbles of said light solvent from said layer of ice slurry which is withdrawn from said ice slurry production tank.

3. The ice slurry production tank of claim 2, wherein said separation means is a downcomer separating said bubbles of said light solvent from a stream of said layer of ice slurry by maintaining a specific downward vertical velocity of a flow of said layer of ice slurry in said downcomer that allows a plurality of ice particles of wanted sizes to be carried with said flow of said layer of ice slurry by the drag forces being higher than the buoyant forces while said bubbles of said light solvent are allowed to rise by the buoyant forces being higher than the drag forces.

4. The ice slurry production tank of claim 1, further comprising a distributor that generates said bubbles of said light solvent being located in said layer of heavy solvent.

5. The ice slurry production tank of claim 1, wherein said layer of heavy solvent is a binary mixture selected from a group consisting of perfluorohexane ($C_6F_{14}$) and perfluorobutyl methyl ether ($C_4F_9OCH_3$), perfluorohexane ($C_6F_{14}$) and 3-ethoxy-1,1,1,2,3,4,4,5,5,6,6,6-dodecafluoro-2-trifluoromethyl hexane ($C_3F_7CF(OC_2H_5)CF(CF)_2$), and perfluorohexane ($C_6F_{14}$) and perfluorohexylethyl 1,3-dimethylbuthyl ether.

6. The ice slurry production tank of claim 1, wherein said water dissolves a freezing point depressant; and wherein said freezing point depressant is insoluable in said heavy solvent and said light solvent.

7. The ice slurry production tank of claim 6, wherein the freezing point depressant is NaCl.

8. The ice slurry production tank of claim 1, wherein an agitator located around an interface between said layer of ice slurry and said layer of light solvent pushes said layer of ice slurry to an exit.

9. The ice slurry production tank of claim 1, wherein said light solvent is chilled in an outside chiller wherein a side of said light solvent of said outside chiller is coated with a hydrophobic coating material.

10. The ice slurry production tank of claim 9, wherein a level of said layer of light solvent in said ice slurry production tank is higher than a level of said outside chiller so that a plurality conduits of said side of said light solvent of said outside chiller is filled with said light solvent.

11. The ice slurry production tank of claim 9, wherein said layer of said light solvent is disposed in a liquid holding volume for flow rates of said light solvent to develop drag forces in said outside chiller for an object selected from a group consisting of water droplets, ice particles and a combination thereof to be carried away.

12. An ice slurry production tank comprising:

a. a layer of heavy solvent immiscible with water and a light solvent, wherein said heavy solvent is higher in density than said water;

b. a layer of said water;

c. a layer of ice slurry, wherein said ice slurry floats in said water;

d. a layer of said light solvent immiscible with said water and said heavy solvent, wherein said light solvent is lower in density than ice;

e. wherein said light solvent is withdrawn and chilled to subzero temperatures in an outside chiller and injected back into said layer of heavy solvent as a cold energy carrier with bubbles of said light solvent being generated; wherein said bubbles of said light solvent rise by buoyant forces through said layer of heavy solvent and said layer of water producing ice in direct contact heat transfer; wherein said bubbles of said light solvent collect above said layer of ice slurry and are withdrawn from said ice slurry production tank; and a headspace blanketed with nitrogen gas when any one of said heavy solvent and said light solvent is flammable.

13. The ice slurry production tank of claim 12, wherein said light solvent is withdrawn from said ice slurry production tank while preventing entrainment of a substance selected from the group consisting of a headspace gas, brine and a combination thereof.

14. The ice slurry production tank of claim 4, wherein said bubbles of said light solvent vaporize generating said ice in said layer of water while ascending; wherein said vaporized a light solvent in a gaseous phase collects above said layer of ice slurry and is withdrawn from said ice slurry production tank.

15. The ice slurry production tank of claim 14, wherein said withdrawn vaporized light solvent is condensed by an outside refrigeration unit to generate a condensate, and a liquid-vapor mixture is composed of at least a liquid wherein the liquid-vapor mixture is generated from said condensate and returns to said distributor in said heavy solvent layer at sub-zero temperatures.

16. The ice slurry production tank of claim 15, wherein said liquid in said liquid-vapor mixture is immiscible with a layer selected from a group consisting of said water layer, said light solvent layer, and said heavy solvent layer.

17. The ice slurry production tank of claim 3, wherein a homogeneous ice slurry product is produced from an exit of said downcomer.

18. The ice slurry production tank of claim 2, wherein a stream of said withdrawn layer of said ice slurry is used to produce a product selected from a group consisting of pure ice, ice particle blocks, ice slurry as a cooling medium, ice slurry in a storage tank and combinations thereof.

19. The ice slurry production tank of claim 1, wherein a brine feed is introduced into said water layer; wherein said brine feed is made by mixing a collection of large ice particles with a warm brine stream while said large ice particles are melting; wherein an agglomeration of said large ice particles is prevented.

* * * * *